US008297459B2

(12) United States Patent
Romanus et al.

(10) Patent No.: US 8,297,459 B2
(45) Date of Patent: Oct. 30, 2012

(54) TANK CONTAINER

(75) Inventors: Susanne Romanus, Siegen (DE); Helge Tenzler, Untermeitingen (DE); Dieter Pfau, Elkenroth (DE)

(73) Assignee: WEW Westerwalder Eisenwerk GmbH, Weitefeld (DE)

( * ) Notice: Subject to any disclaimer, the term of this patent is extended or adjusted under 35 U.S.C. 154(b) by 637 days.

(21) Appl. No.: 12/303,060

(22) PCT Filed: Dec. 21, 2006

(86) PCT No.: PCT/EP2006/012406

§ 371 (c)(1),
(2), (4) Date: Jun. 29, 2009

(87) PCT Pub. No.: WO2007/137619

PCT Pub. Date: Dec. 6, 2007

(65) Prior Publication Data

US 2011/0049165 A1 Mar. 3, 2011

(30) Foreign Application Priority Data

May 30, 2006 (DE) ..... 20 2006 008 574 U

(51) Int. Cl.
*B65D 88/00* (2006.01)

(52) U.S. Cl. ..... 220/1.5

(58) Field of Classification Search ..... 220/608, 220/607, 634, 23.89; D9/455; *B65D 25/24, B65D 90/12*

See application file for complete search history.

(56) References Cited

U.S. PATENT DOCUMENTS 1,761,969 A * 6/1930 Chalmers ..... 206/335
3,115,982 A * 12/1963 Morrison ..... 220/1.5
3,402,845 A * 9/1968 Eriksson ..... 220/1.5
3,661,293 A * 5/1972 Gerhard et al. ..... 220/650
3,726,431 A * 4/1973 Botkin ..... 220/1.5
4,065,022 A 12/1977 Cainaud
4,098,426 A * 7/1978 Gerhard ..... 220/1.5
4,441,678 A * 4/1984 Dorpmund ..... 248/146
4,593,832 A * 6/1986 Gerhard ..... 220/1.5

(Continued)

FOREIGN PATENT DOCUMENTS

CN 2423245 3/2001

(Continued)

OTHER PUBLICATIONS

International Preliminary Report on Patentability dated Feb. 9, 2009 for Application No. PCT/EP2006/012406.

(Continued)

*Primary Examiner* — Mickey Yu
*Assistant Examiner* — Robert J Hicks
(74) *Attorney, Agent, or Firm* — Frost Brown Todd LLC

(57) ABSTRACT

The present invention relates to a tank container (1) having a tank (2) and a framework which receives the tank (2) via end frames (3). Here, the end frames (3) are connected to one another in the lower region via a longitudinal frame structure (5), wherein at least two lateral longitudinal carriers (12) are provided which, in their end regions, have in each case one lateral diagonal member (14) which extends between the longitudinal carrier (12) and a corner support (18) and one base diagonal member (16) which extends between the longitudinal carrier (12) and a lower transverse spar (26, 26'), wherein the base diagonal member (16) and/or the lateral diagonal member (14) have/has an open cross-sectional profile.

18 Claims, 4 Drawing Sheets

U.S. PATENT DOCUMENTS

Figure 1:
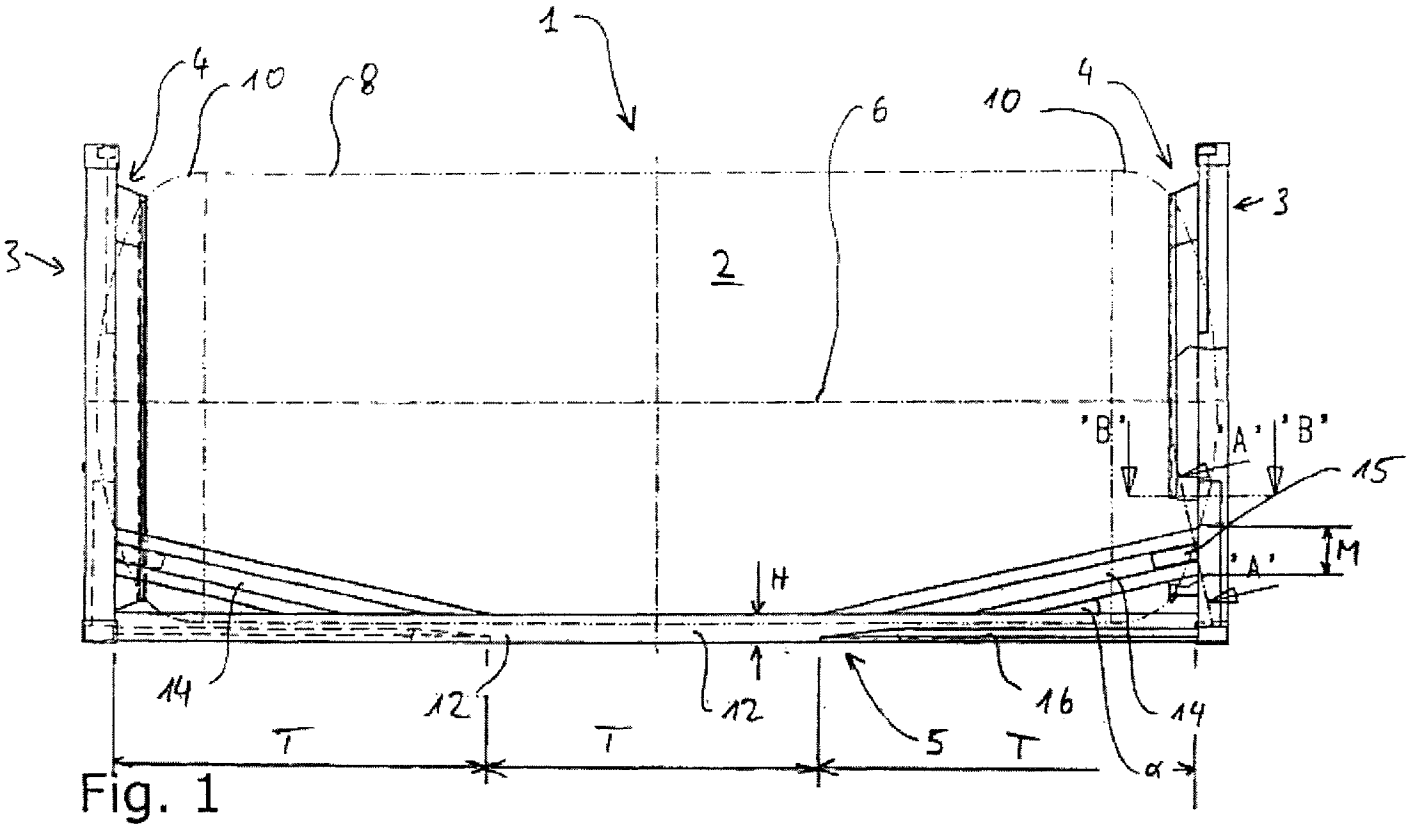

| | | | | |
|---|---|---|---|---|
| 4,603,788 | A * | 8/1986 | Gerhard | 220/1.5 |
| 5,190,179 | A * | 3/1993 | Richter et al. | 220/6 |
| 5,779,077 | A | 7/1998 | Fossey | |

FOREIGN PATENT DOCUMENTS

| | | |
|---|---|---|
| DE | 2 325 058 | 5/1973 |
| DE | 27 07 891 | 9/1977 |
| DE | 32 12 696 | 4/1982 |
| DE | 83 35 251 | 2/1984 |
| DE | 297 05 851 | 8/1998 |
| DE | 297 20 675 | 4/1999 |
| DE | 201 11 808 | 10/2001 |
| DE | 202 11 594 | 12/2003 |
| EP | 0 425 190 | 2/1991 |

OTHER PUBLICATIONS

Abstract from US2004/007580 for Application No. DE 202 11 594.
International Search Report dated Mar. 21, 2007 for Application No. PCT/EP2006/012406.
Abstract from US 5,967,353 for Application No. DE29705851.
English Translation of International Preliminary Report on Patentability for International Application No. PCT/EP2006/012406, Jan. 14, 2009.

* cited by examiner

*(View y)*

*(Cross section A-A)*

*(Cross section B-B)*

*(Cross section C-D)*

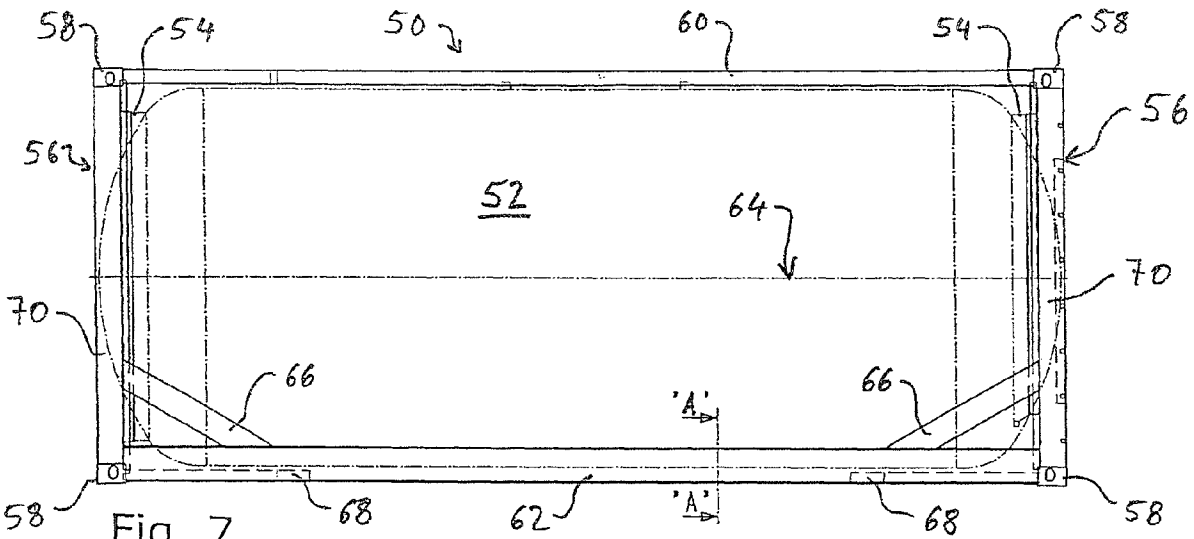
Fig. 7 (State of the Art)
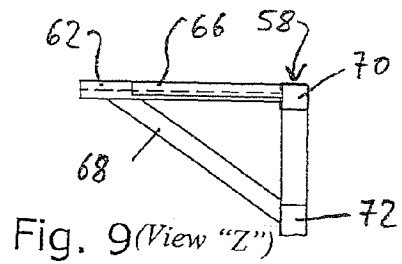
Fig. 9 (View "Z") (State of the Art)
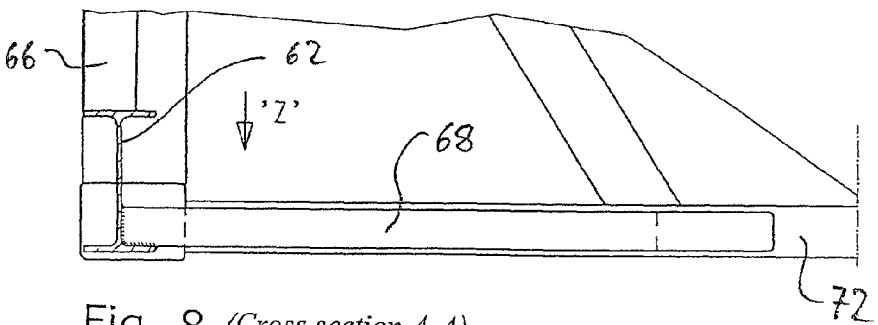
Fig. 8 (Cross section A-A) (State of the Art)

TANK CONTAINER

The invention at hand relates to a tank container (1) having a tank (2) and a framework which receives the tank (2) via end frames (3). Here, the end frames (3) are connected to one another in the lower region via a longitudinal frame structure (5) that has two lateral longitudinal carriers, with the latter being additionally connected to the end frame at their ends in each case via a lateral diagonal member and a base diagonal member. Here, the lateral diagonal members each run in lateral vertical planes at a slant between the longitudinal carrier and a corner support and the base diagonal member—also at a slant—in a horizontal plane close to the bottom between the longitudinal carrier and a lower transverse spar. Here, the corner support and lower transverse spar are elements of the end frame.

Tank containers in which the tank is coupled to an end frame at each of its ends have been known from DE 202 11 594 U1, DE 297 05 851 U1 and from EP 0 425 190 A1, for example.

DE 297 05 851 U1 and DE 202 11 594 U1 show a coupling between tank and end frame via so-called end ring saddling mechanisms.

EP 0 425 190 A1 shows specific saddle elements that connect the tank to the end frame in particular in the area of the corner fittings. This way, transport and handling forces are to be transmitted to the corner fittings as directly as possible and in particular in the area of the lower corner fittings. However, such saddle structures have the disadvantage that they are costly to manufacture and complicate the insulation of the tank since, on the one hand, insulation layers and coverings must be interrupted in this area and, on the other hand, the specific saddle structures represent thermal bridges that cause a great thermal transfer between the tank and its surroundings.

In the meantime, in order to solve this problem, the majority of tank containers that are being manufactured are those in which the tank is connected to the end frame only via the end rings or, respectively, end ring segments. For reinforcement and stabilization, the end frames are provided with additional longitudinal frame structures at least in the area of the lower corner fittings.

FIGS. 7 through 9 show such a tank container. Here, the tank container 50 has a tank 52 that is connected to the end frames 56 via end ring structures at its two ends. Here, upper longitudinal carriers 60 and lower longitudinal carriers 62 run between the upper and lower corner fittings 58. Normally, the tank container 50 is fixed to a transport vehicle (e.g. semi-trailer, container car, ship) via the lower corner fittings 58. In order to direct the transport stresses that act in the transport direction along the longitudinal axis 64 and that are generated by acceleration forces safely away from the tank into the corner fittings 58, a very sturdy construction is required in particular in the bottom area. To this end, the longitudinal carrier is made of a very sturdy and thus relatively heavy hot-roll profile (e.g. EPI 220). In addition, the connection to the end frame is reinforced by lateral diagonal elements 66 and base diagonal elements 68. These base and lateral diagonal elements 68 and 66 are constructed of compact rectangular tube profile and connect the longitudinal spars 62 with the transverse spars 72 or, respectively, the corner supports 70. Such a known construction can be found in FIGS. 7 and 9.

During switching operations during rail transportation, acceleration forces may occur in the direction of the longitudinal axis 64 that are caused by acceleration forces that amount to four to six times those of gravity (g). Therefore, the longitudinal carrier 62 is made very strong in conventional tank containers. Only in this way can it absorb the reaction forces introduced locally by the base and lateral diagonal members 68, 66 without any plastic deformation. In particular the structural elements of the frame make this known design relatively heavy.

Starting from this set of problems, the objective of the invention at hand is to provide an end-saddled tank container with a lighter frame structure. An additional objective may be the optimization of the transfer of forces between tank and frame structure in such a way that the frame structure and in particular the introduction of forces between corner supports, lateral diagonal members and longitudinal carriers or, respectively, between transverse spars, base diagonal members and longitudinal carriers is carried out in such a way that in particular these structural components can be made lighter while having the same stability.

The tank container in accordance with Claim 1 meets this objective, being characterized by the fact that the base and/or lateral diagonal members have an open cross-sectional profile. Such an open cross-sectional profile permits a design of the respective structural elements (base and/or lateral diagonal members) so that the tensions occurring during periods of stress are distributed more evenly and local tension peaks at the connection locations of the structural elements in question (longitudinal carrier, lateral diagonal members, corner support; longitudinal carrier, base diagonal member, transverse spar) are reduced. The open cross-sectional profile permits a "soft" connection that permits a high degree of own elasticity of the overall structure without reducing the necessary stability too much. Therefore, considerably lighter structural elements can be used as longitudinal carriers and as corner supports without reducing the stability of the overall structure too much.

In the further development of the invention in accordance with Claim 2, an open trapeze cross section is provided for the lateral diagonal member, with two lateral portions protruding from a base flange at an angle of between 145 and 165° each. This design permits an extended connection segment of the lateral diagonal member to the longitudinal carriers and to the corner supports. The specially selected slant assures in the marginal areas (i.e. in the areas of the lateral portions) a relatively soft and long coupling with the upper side of the longitudinal carriers that becomes gradually stiffer towards the base flange. Undesired point loads are avoided and buckling stresses on the longitudinal carrier are reduced. The symmetric structure in accordance with Claim 3 permits a cutting scrap-poor manufacture of the lateral diagonal members by trimming correspondingly profiled materials sold by the meter.

The further embodiment of the invention in accordance with Claim 4 permits a further improved load transmission between longitudinal carrier and corner support. The longitudinal design of the lateral diagonal member in accordance with Claim 5 optimizes the free buckling lengths on the longitudinal carrier and leads, together with the measure in accordance with Claim 6, to a further optimized construction in terms of material and weight.

The version in accordance with Claim 7 improves the flow of forces between lateral diagonal member and longitudinal carrier. In this version—with a corresponding design of the longitudinal carrier as a hollow profile—the relatively stable base flange area engages with a relatively soft connecting segment of the longitudinal carrier. This results in an elastic coupling of components with improved stress distribution as well.

The further embodiments of the invention indicated in Claims 8 through 13 relate to the design of the base diagonal member which in accordance with Claim 8 has a cap profile cross section that is open downward. Such a cap profile has structural advantages similar to the open trapeze cross section of the lateral diagonal member described above. But here, the free edges of the lateral shanks are stiffened by means of additional brim shanks (Claim 9). This makes it possible to design the overall profile even flatter while still having sufficient buckling or, respectively, bulging stability. This flat construction allows more ground clearance for connections or, respectively, for insulations of the tank in particular in the connecting area of the base diagonal member to the end-side transverse spars.

This effect is additionally reinforced through the inclination in accordance with Claim 10; at the same time, this design prevents wetness and dirt from collecting on the main flange of the base diagonal member, thereby creating corrosion problems. The arrangement of the angle relative to the longitudinal carrier in accordance with Claim 11 permits a structurally particularly favorable connection here as well and an improved load transfer between transverse spar and longitudinal bearing.

The tapering in accordance with Claim 12 permits a weight-optimized design of the base diagonal member together with a tension-optimized load transfer between transverse spar and longitudinal carrier. The profile depth of the cap profile (height H) in accordance with Claim 13 permits the connection of a relatively flat (low) transverse spar to a relatively high longitudinal spar (seen in vertical direction)—here with a "soft" connection between base diagonal member and longitudinal carrier or, respectively, transverse spar as well.

The overlapping connection areas in accordance with Claim 14 permit a particularly buckle-optimized load introduction of the base and lateral diagonal members into the lateral longitudinal carriers.

The form of the longitudinal carrier in accordance with Claim 15 permits the further optimizable load introductions into the longitudinal carriers in vertical direction (lateral diagonal members) and horizontal direction base diagonal members).

The further embodiment of the invention in accordance with Claims 16 through 18, in conjunction with the special lateral and base diagonal members, permits a considerably lighter version as compared with conventional end ring designs. In this regard, the coupling socket segment in accordance with Claim 17 is particularly easy to install in the alignment of the end frame with the tank, and the further embodiment in accordance with Claim 18 permits a particularly economical manufacture of the saddle ring elements.

Figure 2:
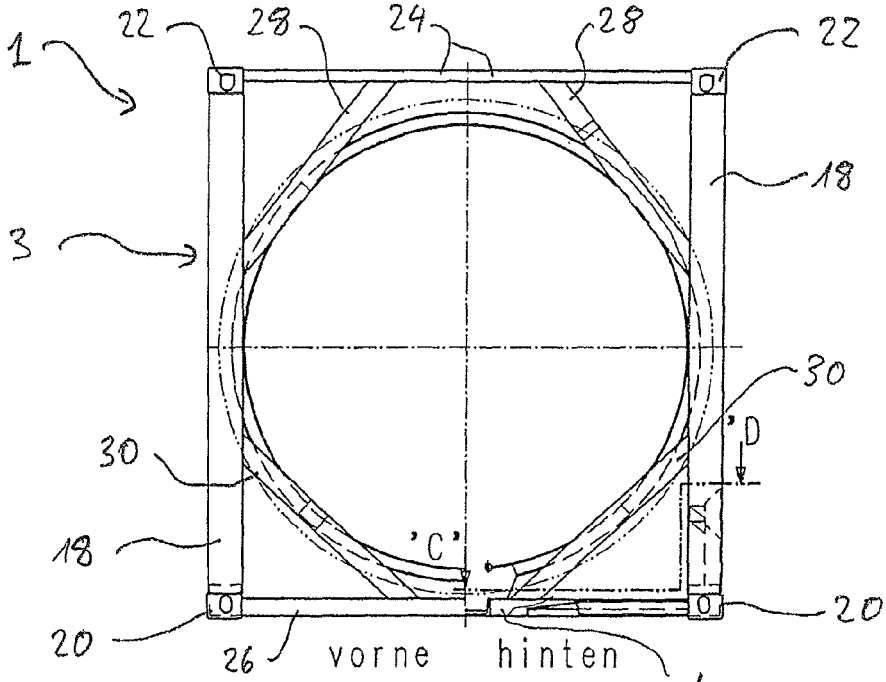
Figure 3:
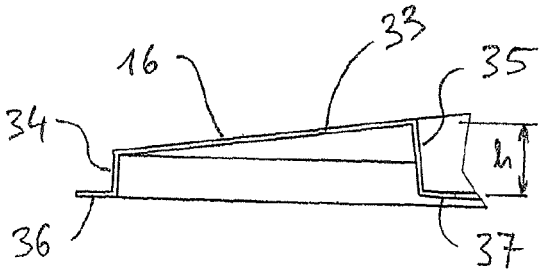
Figure 4:
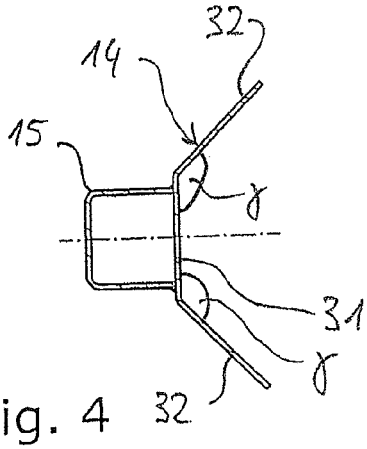
Figure 5:
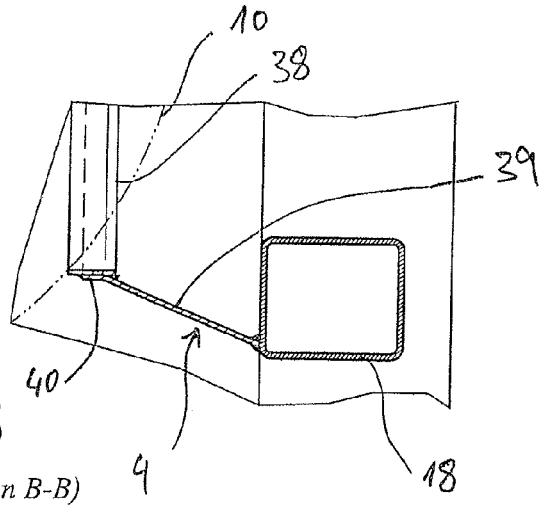
Figure 6:
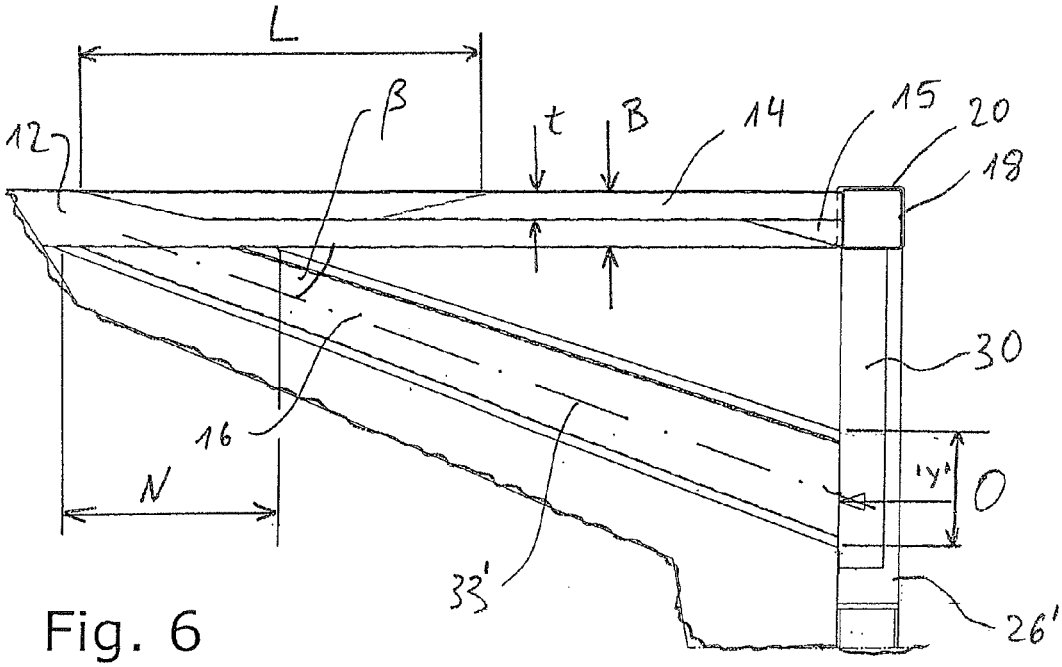

An example of an embodiment of the invention at hand is explained by way of the drawings in exemplary fashion; shown are:

FIG. 1: a lateral view of a tank container in accordance with the invention;

FIG. 2: a divided view of the end frame sides (frontal and from the rear) of the tank container represented in FIG. 1;

FIG. 3: a sectional view of a base diagonal member (view Y from FIG. 6);

FIG. 4: a sectional view of the lateral diagonal member in the connection area to the corner support (sectional view A-A in FIG. 1);

FIG. 5: a sectional representation of the connection area between tank end and end frame (sectional view B-B from FIG. 1);

FIG. 6: a top view of a base diagonal member (partial sectional view C-D from FIG. 2);

FIG. 7: a lateral view of a tank container of the state of the art;

FIG. 8: a lateral view of the end frame section of the tank container represented in FIG. 7 (sectional view A-A from FIG. 7); and FIG. 9: a top view of a base diagonal member of the tank container represented in FIG. 7 (view Z from FIG. 8).

The basic structure of a tank container 1 in accordance with the invention will now be explained in detail by way of FIGS. 1 and 2. The tank container 1 comprises a tank 2 and a frame structure that accommodates the tank 2 via end frames 3 at its ends. For a coupling, one end ring arrangement 4 each is provided between the end frame 3 and the ends of the tank 2 that will be explained in detail below. A longitudinal frame structure 5 that serves in particular to transmit any forces acting along the tank axis runs between the end frames 3 in the bottom area.

The tank 2 is represented in FIGS. 1, 2 and 5 by the dash-umlaut line and is formed by a cylindrical body 8 whose ends are closed with curved end sections. The tank 2 moreover has controls and instruments as well as connections that are not shown here.

The left half of FIG. 1 shows a lateral view of the tank container 1 and the right one, a view in which the frontal frame elements have been cut off. The tank container as shown involves a so-called 20' unit that is particularly common in the case of tank containers; but 10', 30' and 40' units are common as well.

The longitudinal frame structure 5 here comprises lower longitudinal carriers 12 whose ends are in each case connected with the end frame 3. In addition, lateral diagonal members 14 are provided that lead to the end frames 3, starting from the lower longitudinal carriers and running upward at an angle. The base diagonal members 16 are provided in the bottom area that also extend at an angle to the end frames 3 in a vertical plane close to the ground, starting from the lower longitudinal carriers 12 (see also FIG. 6 with regard thereto).

FIG. 2 shows, also in a divided view, the end frames of the tank container 1 from FIG. 1. Here the left half shows the front end and the right half, the rear end of the tank container 1. In the case of tank containers, the end at which controls and instruments (not shown here) are provided at the bottom is designated as the rear end.

The end frames 3 are each composed of corner supports 18, lower corner fittings 20, upper corner fittings 22, an upper transverse spar 24, a lower transverse spar 26 or, respectively, 26', upper end diagonals 28 and lower end diagonals 30.

The lateral diagonal members 14 each connect a segment L (see FIG. 6) at the upper side of the lower longitudinal carriers 12 with a segment M (see FIG. 1) on the side of the corner support 18 facing the tank 2. A reinforcement shoe 15 is arranged on the end frame-side connection end of the lateral diagonal member 14.

The cross section of the lateral diagonal member 14 represented in FIG. 4 shows the connection of the reinforcement shoe 15 to the base flange 31 of the lateral diagonal member 14 from which two lateral shanks 32 jut out. In the example of an embodiment shown, the lateral shanks 32 stick out from the base flange at an angle $\gamma$ of 155°. In other embodiments, this angle is between 145 and 165°. In the example of an embodiment shown, the depth t (see FIG. 6) of the lateral diagonal member amounts to approximately half the width B of the lower longitudinal carrier 12. However, it should amount to at least one third of that width.

The lateral diagonal members 14, together with the lower longitudinal carrier, form an angle $\alpha$ (see FIG. 1) of approximately 13°, in other embodiments this angle fluctuates between 10 and 16°. In this context, the upper or external edges of the lateral diagonal members 14 form upper chords that divide the lower longitudinal spars 12 into three segments T of approximately equal length. The upper or, respectively, inner edges of the lateral diagonal members 14 form lower chords that cut the external segments T approximately in half.

The structure and the arrangement of the lateral diagonal member 14 described above permit a particularly favorable transfer of the tension load between the connection area M to the corner supports 18 and the connection area L on the lower longitudinal carrier 12. The open trapeze profile assures in this context favorable tension transitions with high structural strength and low weight.

Structure and arrangement of the base diagonal member 16 will be explained below in detail by way of FIGS. 3 and 6. The lateral diagonal member represented in FIG. 6 runs from a connection area N on the inner side—facing the tank axis 6—of the longitudinal carrier 12 to a connection area O on the rear side—facing the tank 2—of the lower transverse spar 26'. Here, in the embodiment shown, the longitudinal axis 33' of the base diagonal member 16 forms an angle β of approximately 19° together with the lower longitudinal carrier 12. In other embodiments, this angle fluctuates between 15 and 24°.

FIG. 3 shows that the base diagonal members 16 in cap profile are provided with a main flange 33, two lateral shanks 34 and 35 as well as two brim shanks 36 and 37. The height h of the base diagonal member 16 amounts to at least one third of the height H (FIG. 1) of the longitudinal carrier 12. The main flange 33 tapers along the axis 33' from the connection area O on the lower transverse spar 26 or, respectively, 26' towards the connection area N on the longitudinal carrier 12 so that the two lateral shanks include an angle of approximately 3°. In other embodiments this angle is between 0 and 5°.

In addition, the main flange shows an inclination of approximately 5° relative to the horizontal. In other embodiments this inclination is at least 2°. This measure prevents water or dirt from accumulating on the upper side of the base diagonal member 16.

The cap profile cross section of the base diagonal member 16 represented in FIG. 3 shows that the lateral shanks 34 and 35 run almost vertically and the brim shanks 36 and 37 almost horizontally. In other embodiments the lateral shanks 34 and 35 are opened wider and in each case include an angle of between 90 and 135° with the main flange. The brim shanks 36 and 37 may also be inclined at an angle of between 0 and 5' relative to the horizontal to prevent deposits from forming on its upper side.

The construction and arrangement of the base diagonal member 16 described above permits a tension-optimized load transfer between the lower transverse spars 26 and 26' and the longitudinal carriers 12, and at the same time a flat design. To this effect, the brim shanks 36 and 37 assure a soft attachment to the longitudinal carriers 12 or, respectively, the lower transverse spars 26 and 26' and at the same time provide relatively high buckling stability against pressure forces along the main axis with a flat design.

In the example of an embodiment shown the longitudinal carriers 12 are formed from a square tube with a square cross section. Here, the connection areas L and N of the lateral diagonal member 16 have an overlapping (shaded area in FIG. 6) of approximately 85% relative to the shorter connection area (here N). In other embodiments this overlapping should amount to at least 50% so that the forces engaging in different planes engage with the longitudinal carriers 12 in tension-optimized fashion. In this way, the resulting tensions can be adjusted to the existing cross-sectional profile and the available free buckle lengths.

FIG. 5 shows the structure of the end ring arrangement 4. Here, cylindrical end rings or, respectively end ring segments 38 are arranged at the domed bottoms 10 of the tank that are connected to the end frame 3 via conical saddle ring segments 39 or, respectively, saddle rings. Cylindrical coupling socket segments 40 or, respectively, coupling sockets are arranged at the narrow ends of the saddle ring segments 39 facing the tank that encompass the external cylindrical circumferential surfaces of the end ring segments 38 with their interior circumferential surfaces and that can be dislocated on the latter for positioning purposes during installation. The coupling socket segment 40 may, for example, be crimped to the conical saddle ring segment 39, thereby forming one piece. But it may also be attached as a ring piece.

The wide end of the conical saddle ring segment 39 is connected via its end surface to the corner supports 18, the upper end diagonal member 28 as well as to the lower end diagonal member 30. End ring segments 38 and conical saddle ring segments 39 may either form a closed ring (see frontal view in FIG. 2) or may have interruptions (see rear view in FIG. 2) and expose corresponding recesses for the arrangement of controls and instruments or other accessories on the tank 2. The conical design permits a material-saving and thin-walled execution of the end ring arrangement 4, thereby assuring a stable connection between tank 2 and end frame 3. In the example of an embodiment shown, the opening angle of the conical saddle ring segment is approximately 45°. In other embodiments, this opening angle may be between 30 and 60°.

In the example of an embodiment shown, the lateral diagonal member 14 has an open trapeze profile and the base diagonal member 16, a cap profile. In other embodiments, the base diagonal member 16 may have a trapeze profile as well or, respectively, the lateral diagonal member may have a cap profile.

The base flange 31 of the trapeze profile and the main flange 33 of the cap profile are shown level in FIGS. 3 and 4. Particularly these flanges 31 and 33 may have additional edgings or profiles to improve their structural properties.

Additional embodiments and variations will be obvious to the expert within the framework of the patent claims set forth below.

The invention claimed is:

1. A tank container (1) comprising: a tank (2) and a framework receiving the tank (2) via end frames (3), with the end frames (3) being connected to one another in a lower region via a longitudinal frame structure (5), with at least two lateral longitudinal carriers (12) that have in each of their end areas a lateral diagonal member (14) running between the longitudinal carrier (12) and a corner support (18) and a base diagonal member (16) running between the longitudinal carrier (12) and a lower transverse spar (26, 26'), the tank container further characterized in that the base and/or lateral diagonal members (16, 14) have an open cross-sectional profile.

2. Tank container (1) in accordance with claim 1, with each of the lateral diagonal members (14) having an open trapeze cross-section in which a base flange (31) with each of two lateral shanks (32) emanating therefrom at an angle (γ) of between about 145 degrees and about 165 degrees.

3. Tank container (1) in accordance with claim 2 in which the base flange (31) and the lateral shanks (32), when viewed as the open trapeze cross-section, extend about the same length from a bend interconnecting the base flange (31) and the lateral shanks (32).

4. Tank container (1) in accordance with claim 1 in which each of the lateral diagonal members (14) runs at an angle (α) of between about 10 degrees and about 16 degrees relative to the respective longitudinal carrier.

5. Tank container (1) in accordance with claim 1 in which an external edge of each of the lateral diagonal members (14) forms an upper chord that runs between the corner support (18) and the longitudinal carriers (12) and approximately trisects the respective longitudinal carrier (12).

6. Tank container (1) in accordance with claim 5 in which an internal edge of the lateral diagonal members (14) forms a lower chord that runs between the corner support (18) and the longitudinal carriers (12) and approximately halves the distance on the respective longitudinal carrier (12) between the intersection of the upper chord and the longitudinal carrier (12).

7. Tank container (1) in accordance with claim 1 in which a depth (t) of the lateral diagonal members (14) seen in a horizontal direction at a right angle to a longitudinal axis (6) of the tank container (1) comprises at least one third of a width (B) of a profile of the respective longitudinal earlier.

8. Tank container (1) in accordance with claim 1 in which each of the base diagonal members (16) comprises a cap profile that is open downward.

9. Tank container (1) in accordance with claim 8 in which the cap profile has a main flange (33), which includes a transverse spar (26, 26'), two lateral shanks (34, 35) and two brim shanks (36, 37).

10. Tank container (1) in accordance with claim 9 in which the main flange (33) has an upper surface with an inclination of at least about 3 degrees relative to a horizontal surface of brim shank (36) that extends along a main axis of said main flange (33).

11. Tank container (1) in accordance with claim 8 in which a main axis (33') of the base diagonal members (16) runs at an angle (β) of between about 15 degrees and about 24 degrees relative to the longitudinal carriers (12).

12. Tank container (1) in accordance with claim 9 in which the main flange (33) tapers along a main axis starting from the transverse spar (26, 26') so that the lateral edges of the main flange enclose an angle of between about 0 degrees and about 5 degrees.

13. Tank container (1) in accordance with claim 8 in which a height (h) of the base diagonal members (16) seen in a vertical direction across the longitudinal axis of the tank container corresponds to at least about one third of a height (H) of the respective longitudinal carrier (12).

14. Tank container (1) in accordance with claim 1 in which connection areas (L, N) of the lateral diagonal members (14) and of the base diagonal members (16) overlap each other at least 50% on the longitudinal carriers (12).

15. Tank container (1) in accordance with claim 1 in which each of the longitudinal carriers (12) comprises a hollow profile carrier with a square cross section whose lateral surfaces each run parallel to a vertical or, respectively, a horizontal plane.

16. Tank container (1) in accordance with claim 1 in which the connection between tank (2) and each end frame (3) occurs via a cylindrical end ring segment (38) attached to the tank and a conical saddle ring segment (39) attached to the respective end frame (3).

17. Tank container (1) in accordance with claim 16 in which a cylindrical coupling socket segment (40) is configured on a narrow end of the saddle ring segment (39) facing the tank (2) that abuts an external cylindrical circumferential surface of the end ring segment (38) with its inner cylindrical circumferential surface.

18. Tank container (1) in accordance with claim 17 in which the coupling socket segment (40) is configured as one piece on the saddle ring segment (39).

* * * * *

UNITED STATES PATENT AND TRADEMARK OFFICE

CERTIFICATE OF CORRECTION

PATENT NO. : 8,297,459 B2
APPLICATION NO. : 12/303060
DATED : October 30, 2012
INVENTOR(S) : Susanne Romanus et al.

It is certified that error appears in the above-identified patent and that said Letters Patent is hereby corrected as shown below:

Column 7, Claim 7, line 22, reads "...longitudinal earlier..."; which should be deleted and replaced with "...longitudinal carrier...."

Signed and Sealed this
Twenty-second Day of January, 2013

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,297,459 B2
APPLICATION NO. : 12/303060
DATED : October 30, 2012
INVENTOR(S) : Susanne Romanus It is certified that error appears in the above-identified patent and that said Letters Patent is hereby corrected as shown below:

In the Claims

Column 6, Claim 1, lines 52-53, reads "...longitudinal carrier..."; which should be deleted and replaced with "...longitudinal carriers...."

Column 6, Claim 1, line 54, reads "...longitudinal carrier..."; which should be deleted and replaced with "...longitudinal carriers...."

Signed and Sealed this
Nineteenth Day of November, 2013

Teresa Stanek Rea

Teresa Stanek Rea
*Deputy Director of the United States Patent and Trademark Office*